US005294037A

United States Patent [19]

Schmidt

[11] Patent Number: 5,294,037

[45] Date of Patent: Mar. 15, 1994

[54] METHOD OF ASSEMBLING A METAL GOLF CLUB HEAD

[75] Inventor: Gregory J. Schmidt, Tempe, Ariz.

[73] Assignee: Karsten Manufacturing Corporation, Phoenix, Ariz.

[21] Appl. No.: 47,917

[22] Filed: Apr. 19, 1993

[51] Int. Cl.[5] ..... B23K 31/10; A63B 53/04

[52] U.S. Cl. ..... 228/125; 273/187 H; 273/173; 228/171

[58] Field of Search ..... 273/77 R, 77 A, 167 R, 273/167 A, 167 D, 167 E, 167 F, 167 G, 168, 169, 167 H, 78, 170, 171, 172, 173, 174, 175, 193 R, 194 R, 194 A; 228/125, 135, 164, 171; 29/464, 466

[56] References Cited

U.S. PATENT DOCUMENTS

| | | | |
|---|---|---|---|
| 2,249,723 | 7/1941 | Orr | 228/164 |
| 3,180,021 | 4/1965 | Cordea | 228/164 |
| 4,085,934 | 4/1978 | Churchward | 273/171 |
| 4,139,196 | 2/1979 | Riley | 273/167 H X |
| 4,214,754 | 7/1980 | Zebelean | 273/167 H |
| 4,319,752 | 3/1982 | Thompson | 273/167 H X |
| 4,417,731 | 11/1983 | Yamada | 273/167 H |
| 4,429,879 | 2/1984 | Schmidt | 273/167 H |
| 4,438,931 | 3/1984 | Motomiya | 273/167 H |
| 4,465,221 | 8/1984 | Schmidt | 228/125 |
| 4,630,825 | 12/1986 | Schmidt | 273/167 H |
| 4,714,577 | 12/1987 | Nagamoto et al. | 364/46.6 |
| 4,944,515 | 7/1990 | Shearer | 273/167 H |
| 5,028,049 | 7/1991 | McKeighen | 273/167 H |
| 5,094,383 | 3/1992 | Anderson | 273/167 H X |
| 5,106,094 | 4/1992 | Desbiolles | 273/167 H |

*Primary Examiner*—Vincent Millin
*Assistant Examiner*—Sebastiano Passaniti
*Attorney, Agent, or Firm*—Herbert E. Haynes, Jr.; Darrell F. Marquette

[57] ABSTRACT

A metal golf club head includes a main body and a sole plate. The main body has a front wall arranged for impacting a golf ball, a top wall, a bottom wall with an opening formed therein, and a rear wall. The sole plate closes the opening in the bottom wall of the main body. A circular ridge circumscribes the main body opening and projects downwardly from the main body. The sole plate has a circular ridge extending around its periphery and projecting downwardly. When the sole plate is inserted in the main body opening, the circular ridges on the main body and the sole plate are juxtaposed. Then, these circular ridges are fused together in order to affix the sole plate to the main body.

10 Claims, 2 Drawing Sheets

METHOD OF ASSEMBLING A METAL GOLF CLUB HEAD

BACKGROUND OF THE INVENTION

This invention relates generally to golf clubs and, in particular, to a method of assembling a metal golf club head.

U.S. Pat. No. 4,465,221 to Schmidt discloses a method of making a metal golf club head having a main body and a sole plate. The main body of the club head has an opening formed in its bottom wall as a result of an investment casting process used in making the main body. A ledge circumscribes the opening for supporting the sole plate during a welding operation. A welded joint is formed in a gap between the main body and the sole plate in order to affix the sole plate to the main body. A drawback of the method disclosed in the Schmidt patent is that the ledge used to support the sole plate becomes distorted during the investment casting process and thus does not properly support the sole plate. Furthermore, this ledge is difficult, if not impossible, to straighten. Another drawback of providing a ledge to support the sole plate during the welding operation is that the bottom wall of the main body must be thicker than otherwise required. A further drawback of the prior method is that the sole plate is not fully secured to the ledge even though the sole plate rests on the ledge during the welding operation.

SUMMARY OF THE INVENTION

The present invention provides a method of assembling a metal golf club head comprising the step of providing a main body formed of metal having a front wall with a face arranged for impacting a golf ball, a top wall, a bottom wall with an opening formed therein, and a rear wall. The main body has a ridge circumscribing the opening in the bottom wall and projecting outwardly from the bottom wall. The method also comprises the step of providing a sole plate formed of metal for closing the opening in the bottom wall of the main body. The sole plate has a ridge extending around its periphery and projecting outwardly therefrom. The sole plate is inserted in the opening in the main body bottom wall so that the opening is closed by the sole plate and so that the ridges on the main body and the sole plate are juxtaposed. The juxtaposed ridges are fused together in order to affix the sole plate to the main body.

In its preferred embodiment, the method of the present invention further comprises the steps of providing a plurality of notches in the ridge on the main body thereby dividing the main body ridge into a plurality of arcuate ridge sections, providing a plurality of locator tabs on the sole plate, and positioning the sole plate and the main body during the inserting step so that the locator tabs are disposed in the notches.

DESCRIPTION OF THE PREFERRED EMBODIMENT

Figure 1:
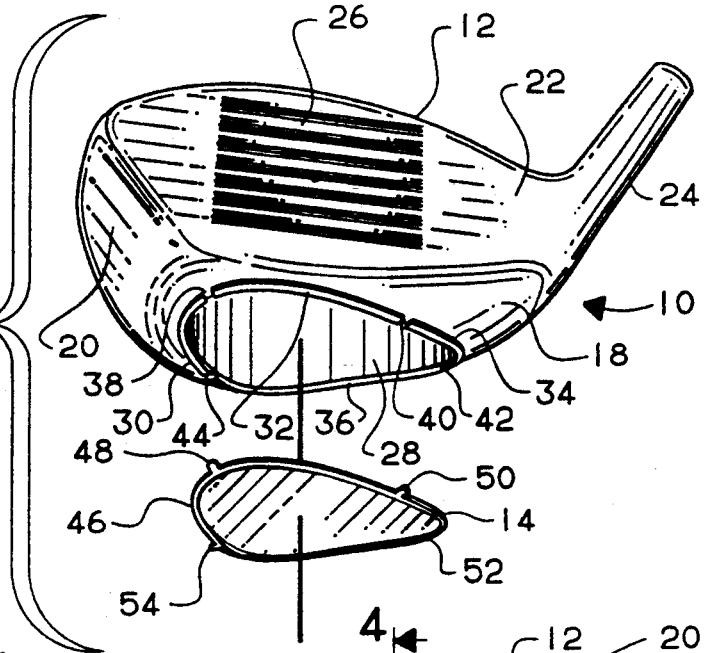
FIG. 1 is an exploded perspective view of a golf club head having a main body and a sole plate assembled by a method according to the present invention.
Figure 2:
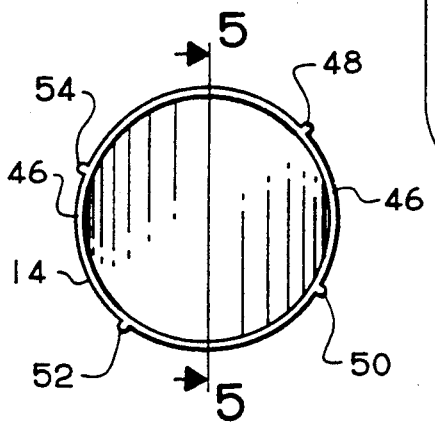
FIG. 2 is a bottom view of the sole plate shown in FIG. 1.
Figure 3:
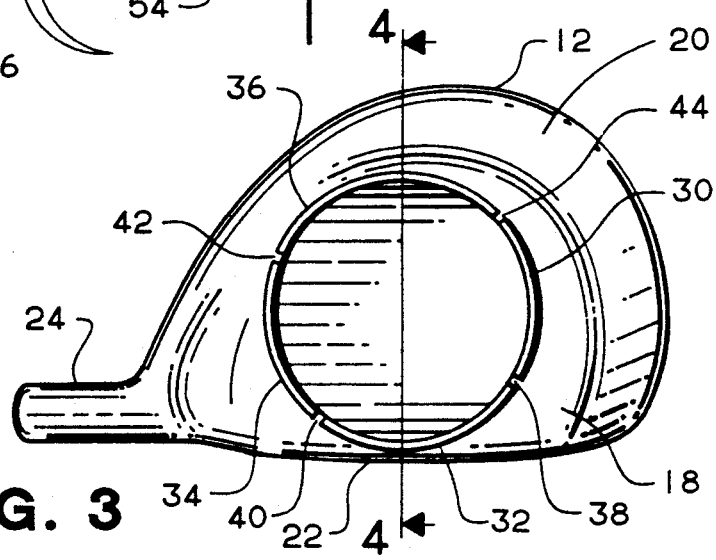
FIG. 3 is a bottom view of the main body shown in FIG. 1.
Figure 4:
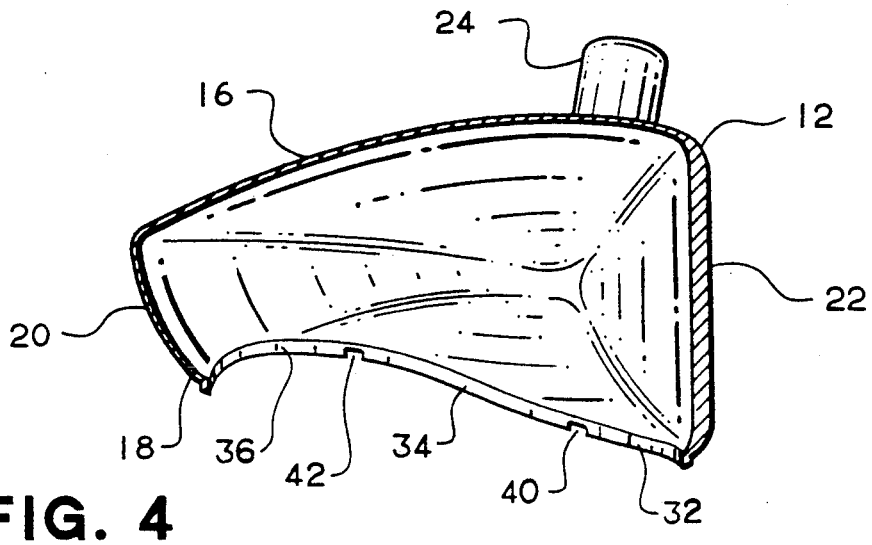
FIG. 4 is a cross-sectional view taken along lines 4—4 in FIG. 3.
Figure 5:
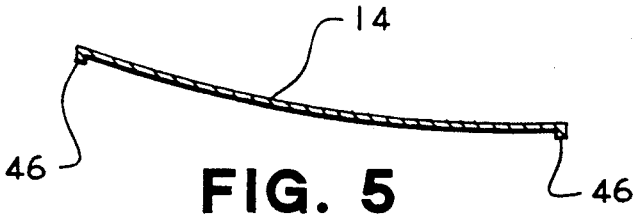
FIG. 5 is a cross-sectional view taken along lines 5—5 in FIG. 2.
Figure 6:
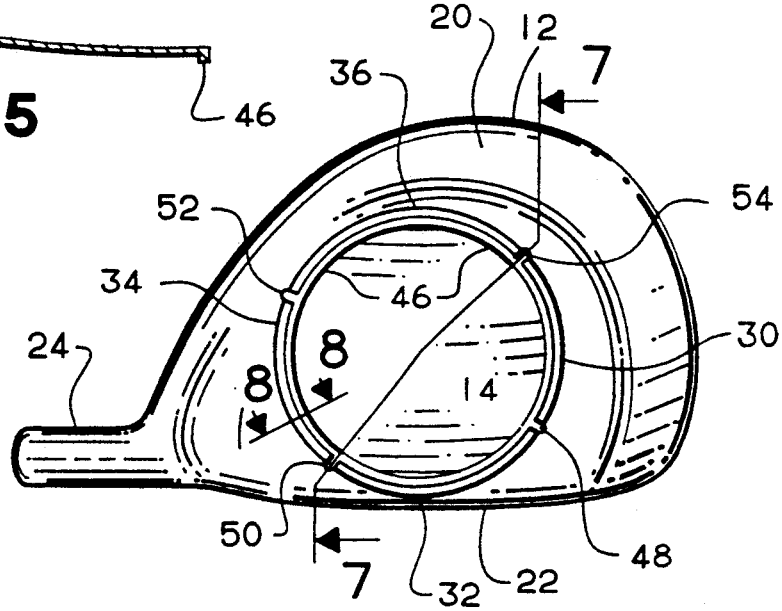
FIG. 6 is a bottom view of the golf club head of FIG. 1 with the main body and the sole plate assembled together.
Figure 7:
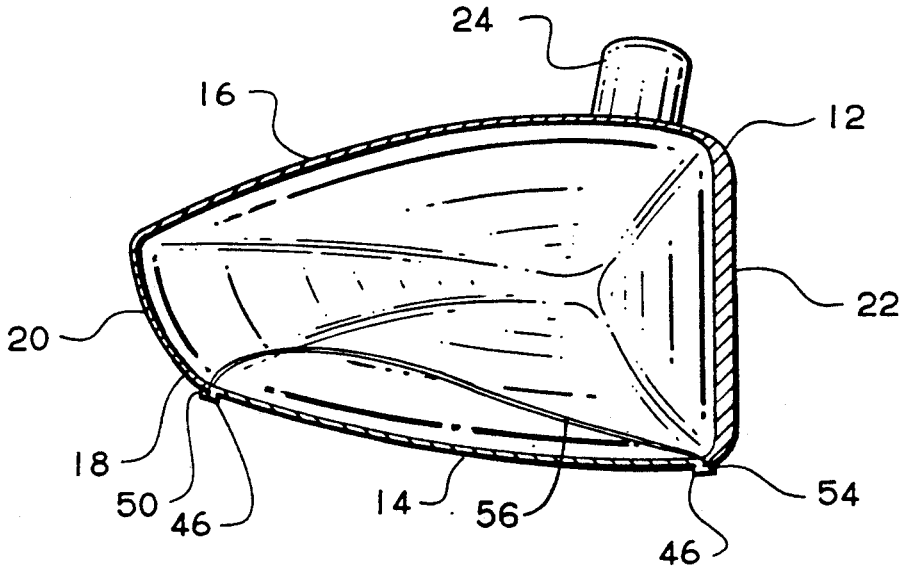
FIG. 7 is a cross-sectional view taken along lines 7—7 in FIG. 6.

Referring to FIGS. 1-5, a golf club head 10 includes a main body 12 and a sole plate 14 which are preferably formed of a suitable metal such as stainless steel. The main body 12 has a top wall 16, a bottom wall 18, a rear wall 20, a front wall 22, and a hosel 24. The top, bottom and rear walls 16, 18 and 20 each have a thickness between 0.036 and 0.040 inch, whereas the front wall 22 has a thickness between 0.128 and 0.135 inch. A face 26 is arranged on the front wall 22 for impacting a golf ball, and the hosel 24 is adapted for receiving one end of an elongated shaft (not shown). The bottom wall 18 has a generally circular opening 28 formed therein which is closed by the sole plate 14.

A substantially circular ridge consisting of four arcuate ridge sections 30, 32, 34 and 36 is provided on the bottom wall 18 of the main body 12. The ridge sections 30, 32, 34 and 36 are spaced apart by four notches 38, 40, 42 and 44. Each of the ridge sections 30, 32, 34, 36 has a height of approximately 0.030 inch and a width of approximately 0.075 inch. The sole plate 14 has a circular ridge 46 extending around its periphery and four locator tabs 48, 50, 52, 54 spaced asymmetrically about the periphery thereof. The sole plate ridge 46 has an approximate height of 0.030 inch and an approximate width of 0.075 inch. Since the notches 38, 40, 42, 44 and the locator tabs 48, 50, 52, 54 are not evenly spaced, the sole plate 14 will have a registered fit with the main body opening 28.

The main body 12 and the sole plate 14 are both formed by an investment casting process known as the "lost wax" method. Although the main body opening 28 is designed to be perfectly circular, the casting process causes the opening 28 to have a distorted shape that is not a perfect circle. Therefore, after the casting process, the opening 28 is machined by a precision boring tool so that the opening 28 is returned to its perfect circular shape. This machining of the opening 28 is necessary to insure proper mating of the main body 12 and the sole plate 14.

Figure 8:
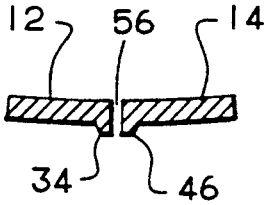
FIG. 8 is an enlarged sectional view taken along lines 8—8 in FIG. 6.
Figure 9:
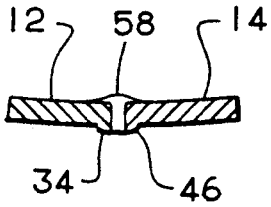
FIGS. 9 and 10 are sectional views similar to FIG. 8 at different steps in the method of the present invention.

Next, the sole plate 14 is inserted in the opening 28 with the locator tabs 48, 50, 52 and 54 received in the notches 38, 40, 42 and 44, respectively, to correctly orient the sole plate 14 relative to the main body 12. Since this is the only manner in which the sole plate 14 may be properly mated with the main body 12, improper mating of the main body 12 and the sole plate 14 is prevented. With the sole plate 14 inserted in the opening 28, the ridge 46 lies adjacent each of the ridge sections 30, 32, 34, 36 so that a robotic welding apparatus (not shown) may be used to fuse the ridge sections 30, 32, 34, 36 to the ridge 46. The locator tabs 48, 50, 52, 54 support the sole plate 14 during the welding operation and thus prevent it from falling into the main body 12. As best shown in FIG. 8, there is a gap 56 of approximately 0.005 inch between the ridge 46 and each of the juxtaposed ridge sections 30, 32, 34, 36. When the metal forming the ridge 46 and the ridge sections 30, 32, 34, 36 is melted, most of it flows into the gap 56 and forms a welded joint 58 between the main body 12 and the sole plate 14. This welded joint 58, shown in FIGS. 9 and 10, affixes the sole plate 14 to the main body 12.

Figure 10:
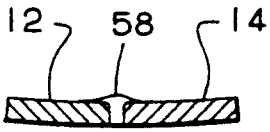

Finally, all excess metal remaining where the ridges 30-36 and 46 existed is removed. A conventional grinding wheel (not shown) may be used to remove this excess metal so that the main body 12, the sole plate 14, and the welded joint 58 all have a smooth exterior appearance as shown in FIG. 10.

The sole plate 14 has a thickness which may be adjusted in a range between 0.035 and 0.080 inch. Such adjustment of the sole plate thickness will accommodate swingweight adjustments for the golf club head 10.

An important advantage of the method of the present invention is that no additional welding material is used in forming the welded joint 58.

Another important advantage of the method of the present invention is that the ridge sections 30, 32, 34, 36 add strength and rigidity to the bottom wall 18 of the main body 12 thereby minimizing straightening of the bottom wall 18 subsequent to casting the main body 12. The ridge 46 adds strength and rigidity to the sole plate 14.

It will be understood that the boring of the main body opening 28, as discussed above, is necessary to give a tight enough fit between the sole plate 14 and the main body 12 to permit use of a robotic welding apparatus when affixing the sole plate 14 to the main body 12.

What is claimed is:

1. A method of assembling a metal golf club head comprising the steps of:

providing a main body formed of metal having a front wall with a face arranged for impacting a golf ball, a top wall, a bottom wall with an opening formed therein, and a rear wall, said main body having a ridge circumscribing the opening in said bottom wall, said ridge having a height projecting outwardly from said bottom wall;

providing a sole plate formed of metal for closing the opening in said bottom wall of said main body, said sole plate having a ridge extending around its periphery, said sole plate ridge having a height and projecting outwardly from said sole plate;

inserting said sole plate in the opening in said main body bottom wall so that said opening is closed by said sole plate and so that said ridges on said main body and said sole plate are juxtaposed; and fusing said ridges together in order to affix said sole plate to said main body.

2. The method of claim 1, wherein the fusing step is performed by a robotic welding apparatus.

3. The method of claim 1, further comprising the step of removing any excess metal where said ridges were located on the main body and the sole plate, and wherein the removing step is performed after the fusing step.

4. The method of claim 3, wherein the removing step is carried out by using a grinding wheel.

5. The method of claim 1, further comprising the steps of:

providing a plurality of notches in the ridge on said main body thereby dividing said main body ridge into a plurality of ridge sections;

providing a plurality of locator tabs on said sole plate; and positioning said sole plate and said main body, during said inserting step, so that said locator tabs are disposed in said notches.

6. The method of claim 5, wherein said notches are spaced unevenly around a circumference of said opening, and wherein said locator tabs are spaced unevenly around the periphery of the sole plate so that said sole plate has a registered fit within said opening.

7. The method of claim 6, wherein said plurality of notches comprises four notches, and wherein said plurality of locator tabs comprises four locator tabs.

8. The method of claim 5, wherein said ridge sections on said main body have a height of approximately 0.030 inch and a width of approximately 0.075 inch, and wherein said ridge on said sole plate has an approximate height of 0.030 inch and an approximate width of 0.075 inch.

9. The method of claim 8, wherein the main body opening is substantially circular, and further comprising the step of machining the main body opening to make it perfectly circular, the machining step is performed before the inserting step.

10. The method of claim 9, wherein a boring tool is used to perform the machining step.

* * * * *